US006341744B1

(12) United States Patent
Sugiuchi

(10) Patent No.: US 6,341,744 B1
(45) Date of Patent: Jan. 29, 2002

(54) COIL WINDING APPARATUS AND WINDING METHOD

(75) Inventor: Yousuke Sugiuchi, Iino-machi (JP)

(73) Assignee: Nittoku Engineering Kabushiki Kaisha, Urawa (JP)

( * ) Notice: Subject to any disclaimer, the term of this patent is extended or adjusted under 35 U.S.C. 154(b) by 0 days.

(21) Appl. No.: 09/638,913

(22) Filed: Aug. 16, 2000

(30) Foreign Application Priority Data

Dec. 22, 1999 (JP) ..... 11-364948

(51) Int. Cl.[7] ..... B65H 54/28; B65H 81/06

(52) U.S. Cl. ..... 242/483.3; 242/447.2; 242/474.8; 242/484.1

(58) Field of Search ..... 242/474.8, 476.8, 242/477.1, 479.6, 480.2, 483.3, 483.5, 484.1, 484.5, 445.1, 447.2, 447.1

(56) References Cited

U.S. PATENT DOCUMENTS 2,194,950 A * 3/1940 Miesch ..... 242/479.6
2,401,676 A * 6/1946 Weber ..... 242/447.1
2,726,821 A * 12/1955 Enabnit ..... 242/479.6
4,065,065 A * 12/1977 Kallenborn ..... 242/476.8
4,114,821 A * 9/1978 Thoma et al. ..... 242/476.8
5,564,637 A * 10/1996 Berthold et al. ..... 242/477.1 X
5,950,956 A * 9/1999 Yukitake ..... 242/447.1
5,988,554 A * 11/1999 Taka ..... 242/445.1 X
6,193,185 B1 * 2/2001 Kim ..... 242/474.8 X

* cited by examiner

*Primary Examiner*—Michael R. Mansen
(74) *Attorney, Agent, or Firm*—Rabin & Berdo

(57) ABSTRACT

A coil winding apparatus 1 includes a transvers mechanism which displaces a wire supply part 8 and a spinds 5 to which a bobbin 4 is fitted relative to each other in an axial direction. This traverse mechanism includes a first traverse mechanism 11 and a second traverse mechanism 15 which have a different displacement range and displacement pitch. The first traverse mechanism 11 and second traversemechanism 15 are displaced independently of one another, so even when a wire of fine diameter is rapidly wound on a narrow width, the coil winding alignment does not break down, and the coil turns can be wound at high speed in an orderly arrangement.

10 Claims, 2 Drawing Sheets

COIL WINDING APPARATUS AND WINDING METHOD

FIELD OF THE INVENTION

The present invention relates to an improved coil winding apparatus having a traverse mechanism for moving a wire supply part in the axial direction of a coil bobbin in synchronism with the rotation of the bobbin so as to wind turns of wire on the bobbin in alignment, and to an improved coil winding method for doing the same.

BACKGROUND OF THE INVENTION

When turns of wire are wound in alignment on the bobbin of a coil, a nozzle which supplies the wire is moved in an axial direction of the bobbin in synchronism with the rotation of the bobbin. The nozzle is moved at a pitch equal to the diameter of the wire on each rotation of the bobbin so that an alignment of wire turns is achieved.

In a traverse mechanism of a prior art coil winding apparatus, when the wire is wound, a nozzle displacement mechanism moves the nozzle a distance corresponding to the wire diameter, and when the bobbin is removed or other operations are performed on the bobbin after winding is finished, the nozzle is moved to a position in which it does not interfere with these operations.

Specifically, when the bobbin is removed, the nozzle must be displaced to a position which does not overlap with the bobbin, so the range of displacement of the nozzle is much larger than the width of the bobbin. The displacement speed and displacement distance of the nozzle are different during coil winding and when the bobbin is removed, however both of these displacements are performed with one traverse mechanism, so the traverse mechanism necessarily has a large range of motion and is bulky.

However, in this bulky traverse mechanism which has a large range of displacement, there is a limit to the resolution that can be obtained in performing small pitch displacements such as when winding a fine wire, and it cannot be displaced with a precise pitch.

When a narrow width is traversed at high speed as in the case of a transformer or ignition coil, if the nozzle is moved at high speed by a bulky traverse mechanism, vibration occurs when the traverse mechanism displaces and particularly when the displacement direction is reversed. Moreover, as the bulky traverse mechanism is also heavy, it does not stop immediately even if the displacement is stopped, and it does not reverse immediately even if the displacement direction is reversed. In other words, if the traverse mechanism is large, its inertia is large, and its ability to perform displacements and reverse its direction of motion is poor. Due to these factors, in a prior art traverse mechanism, the wire was not fed out smoothly, the alignment of coil windings sometimes broke down, and high speed, precise winding of wire turns in alignment was difficult.

For example, ignition coils may be broadly distinguished as bank-wound ignition coils and section-wound ignition coils, but in both cases, the wire turns are wound in alignment at high speed on plural narrow widths of a bobbin shell. In a prior art, bulky traverse mechanism, there was a problem regarding resolution and vibration. With bank-wound ignition coils, the winding alignment sometimes broke-down, and with section wound ignition coils, high speed, precise winding of wire turns in alignment was difficult.

SUMMARY OF THE INVENTION

It is therefore an object of the present invention to provide a coil winding apparatus and coil winding method wherein a wire supply nozzle can be displaced by an accurate pitch even when a fine diameter wire is wound, vibration does not occur in the case of high speed displacement or reverse displacement, a fast response is achieved when the direction of motion is reversed, feeding of the wire is not prone to error, the coil winding alignment does not break down, and the wire turns can be precisely wound in alignment at high speed.

To achieve the above object a coil winding apparatus of this invention comprises a spindle on which a bobbin is fitted, a wire supply part for feeding out a wire and winding it around the bobbin, a mechanism which causes the spindle and wire supply part to perform rotation relative to the spindle axis, and a traverse mechanism which causes the spindle and wire supply part to perform relative displacement in the axial direction of the spindle. The traverse mechanism comprises a first traverse mechanism and a second traverse mechanism which operate independently of one another.

This invention also provides a coil winding method which uses a spindle on which a bobbin is fitted and a wire supply part for feeding out the wire and winding it around the bobbin are provided, the spindle and wire supply part are made to rotate relative to the spindle axis, and the coil is wound while the wire supply part and the spindle are made to perform relative displacement in the axial direction of the spindle due to the first and second traverse mechanisms.

According to this invention, a traverse mechanism is provided with a first traverse mechanism and a second traverse mechanism which operate independently of one another, the first traverse mechanism and second traverse mechanism being operated selectively or in conjunction with one another when winding a wire or removing a bobbin. When winding a wire coil, the mechanisms are moved with an optimum displacement pitch and speed, the displacement is smooth, the coil winding alignment does not break down, and the coil can therefore be wound accurately. When removing a bobbin, the wire supply nozzle can be moved to a position with high speed where it does not interfere. Hence, the entire winding process can be performed more efficiently.

The details as well as other features and advantages of the present invention are set forth in the remainder of the specification and are shown in the accompanying drawings.

DESCRIPTION OF THE PREFERRED EMBODIMENTS

Figure 1:
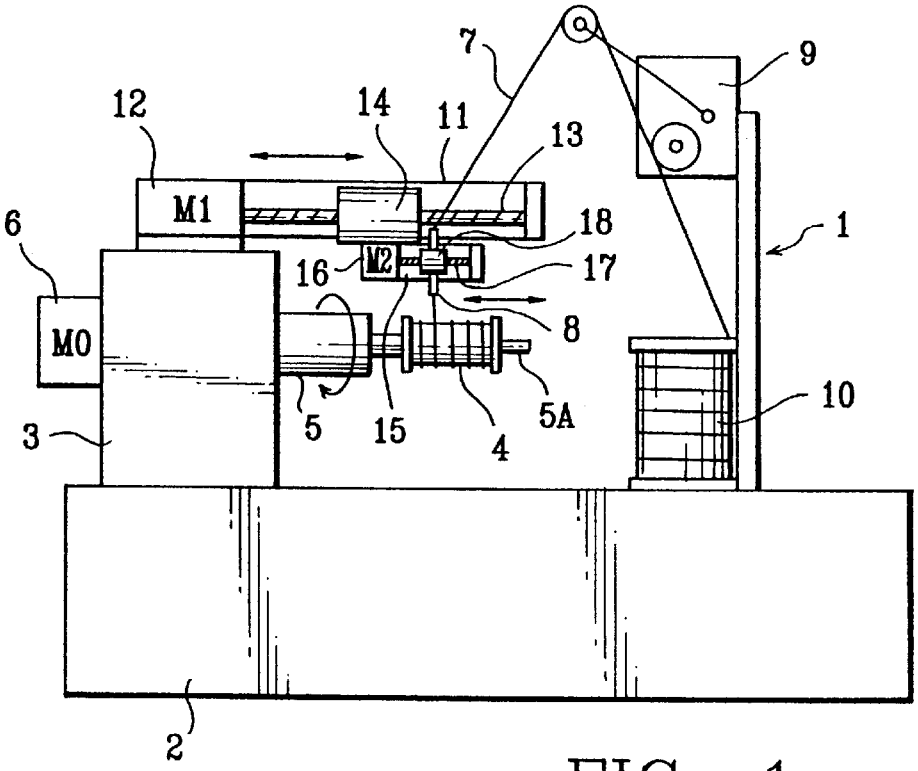
FIG. 1 is a schematic diagram of a coil winding apparatus according to the present invention.

Embodiments of the present invention will now be described referring to the drawings.

In FIG. 1, a frame 3 is attached to a platform 2 of a coil winding apparatus 1, a spindle 5 being supported by this frame 3. The spindle 5 is joined to a spindle motor 6 through the frame 3, and a jig 5A is provided at one end of the spindle 5 so that a bobbin 4 can be freely attached and removed. The bobbin 4 has a flange at each end, and a wire 7 is wound around the bobbin 4 between these two flanges.

The spindle 5 rotates together with the spindle motor 6, and when the bobbin 4 rotates due to the rotation of the spindle 5, the wire 7 supplied from a nozzle 8 is wound around the bobbin 4.

The winding apparatus 1 is further provided with the nozzle 8, a tension device 9 and a spool 10. As the nozzle 8 supplies the wire 7 from the spool 10, the wire 7 is wound around the bobbin 4. The tension device 9 maintains the tension of the wire 7, which is fed out from the spool 10 on which the wire 7 is stored to the nozzle 8, at a fixed level.

The winding apparatus 1 of the present invention further comprises a first traverse mechanism 11 and a second traverse mechanism 15 which displace the nozzle 8 parallel to the axis of the spindle 5.

The first traverse mechanism 11 is attached to the frame 3. This first traverse mechanism 11 comprises a first traverse motor 12, a first traverse shaft 13 which is joined to the shaft of the first traverse motor 12 and disposed parallel to the spindle 5, and a first base 14 which displaces along the first traverse shaft 13. The first traverse shaft 13 is a screw shaft having a screw thread on its outer circumference. The first base 14 has a screw hole into which the screw thread of the first traverse shaft 13 screws. When the first traverse motor 12 rotates, the base 14 is displaced along the first traverse shaft 13.

The second traverse mechanism 15 is attached to the first base 14. This second traverse mechanism 15 comprises a second traverse motor 16, a second traverse shaft 17 which is joined to the second traverse motor 16 and disposed parallel to the first traverse shaft 13, and a second base 18 which is displaced along the second traverse shaft 17.

As in the case of the first traverse mechanism 1, in the second traverse mechanism 15, the second traverse shaft 17 is a screw shaft having a screw thread on its outer circumference. The second base 18 has a screw hole into which the screw thread of the second traverse shaft 17 screws. The second base 18 is displaced along the second traverse shaft 17 due to the rotation of the second traverse motor.

According to this embodiment, the nozzle 8 is fixed to the base 18 of the second traverse mechanism 15. Therefore, when the traverse motor 12 of the first traverse shaft 13 rotates, the first base 14 is displaced, the second base 18 of the second traverse mechanism 15 which is attached to this base 14 is displaced together with it, the nozzle 8 performs a traverse movement parallel to the spindle 5, and the position of the nozzle 8 relative to the bobbin 4 changes.

Likewise, when the traverse motor 16 of the second traverse mechanism 15 rotates, the base 18 is displaced, and the nozzle 8 performs a traverse movement. These traverse movements of the nozzle 8 can also be performed simultaneously while the traverse motors 12 and 16 are rotated.

The first traverse mechanism 11 displaces the second traverse mechanism 15 and the nozzle 8, so a large, powerful motor is used for the first traverse motor 12. The first traverse shaft 13 has a large diameter, and it has a screw thread having a large pitch.

On the other hand, the second traverse mechanism 15 only displaces the nozzle 8, so it is compact and lightweight. A compact motor is used for the second traverse motor 16. The second traverse shaft 17 has a small diameter, and it has a screw thread having a fine pitch.

Therefore, the nozzle 8 can be displaced with a large pitch over a wide range due to the first traverse mechanism 11, and it can be displaced with a fine pitch over a narrow range due to the second traverse mechanism 15.

It may be noted that even if screws of identical pitch are used for the first traverse shaft 13 and second traverse shaft 17, fine pitch displacements can be made by the second traverse mechanism 15 by varying the rotation speeds of the traverse motors 12, 16.

The winding operation performed by the winding apparatus of this invention will now be described referring to FIG. 1.

The bobbin 4 is fitted to the jig 5A of the spindle 5, and the spindle motor 6 is rotated. The wire 7 is supplied from the spool 10 to the nozzle 8 via the tension device 9. As the bobbin 4 is rotating due to the rotation of the spindle motor 6, the wire 7 fed out from the nozzle 8 is wound on the outer circumference of the bobbin 4.

In this state, while the motion of the first traverse mechanism 11 has been stopped, the nozzle 8 is displaced in the axial direction of the bobbin 4 by the second traverse mechanism 15 by a distance corresponding to the diameter of the wire 7 each time the bobbin 4 rotates.

The second traverse mechanism 15 starts moving the nozzle 8 from the wind start position of the coil of the bobbin 4, and when the nozzle 8 has reached the wind end position, the second traverse mechanism 15 reverses its direction of motion so that the nozzle 8 moves in the reverse direction. In this way, the nozzle 8 performs back and forth movements a predetermined number of times between the flanges of the bobbin 4 due to the second traverse mechanism 15 while the wire 7 is being wound on the bobbin 4. Plural layers of turns of the wire 7 are therefore wound in alignment on the bobbin 4 so as to form a coil.

After one coil has been wound, the second traverse mechanism 15 is stopped, the bobbin 4 which has finished winding is removed, and a new bobbin is attached to start another winding operation. When the previous bobbin 4 is removed, the first traverse mechanism 11 which has a large displacement range is operated to move the nozzle 8 to a position where it does not interfere with removal of the old bobbin 4 and fitting of the new bobbin. After the new bobbin 4 has been fitted, the nozzle 8 is returned to its initial position by the first traverse mechanism 11.

Hence, according to the preset invention, by providing the first traverse mechanism 11 and second traverse mechanism 15 which have different displacement ranges and displacement pitches, the first traverse mechanism 11 and second traverse mechanism 15 may be operated selectively during the winding and the removal of the bobbin. Therefore, the nozzle 8 can be displaced with optimum pitch and speed while maintaining the required displacement distance, and winding can be performed very efficiently. Further, during winding, the second traverse mechanism 15 is displaced in the axial direction of the bobbin 4 at a high speed and with a fine pitch, so even a fine wire coil can be wound precisely. Finally, the nozzle 8 can be moved and reversed at high speed, and as the displacing mass is small when motion is reversed, vibrations and shocks do not easily occur.

Next, the control system of this invention will be described referring to FIG. 2.

Figure 2:
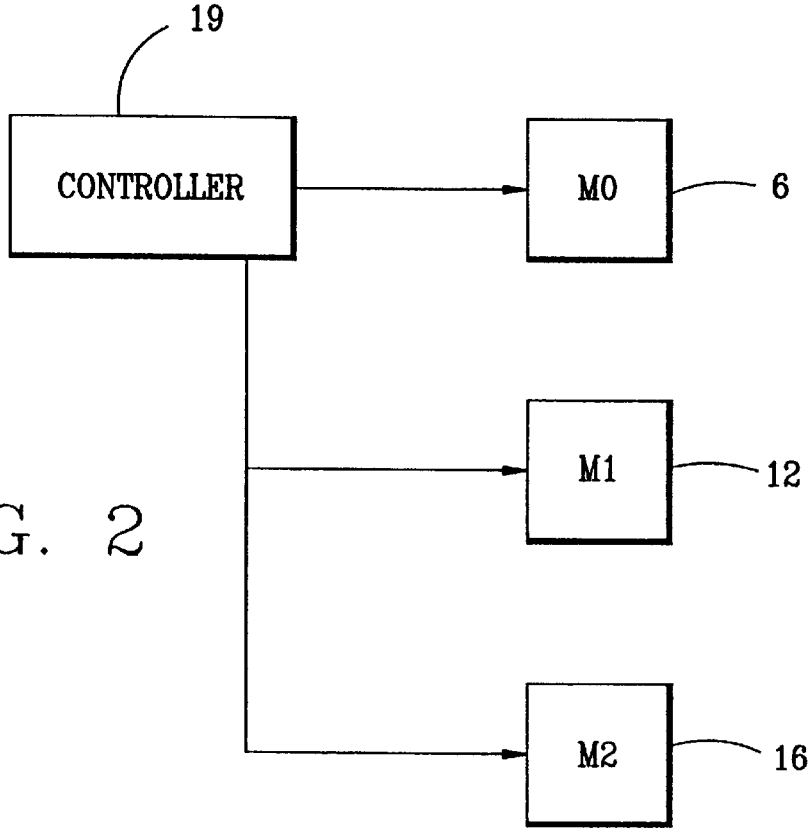
FIG. 2 is a block diagram showing a control system of the coil winding apparatus according to this invention.

FIG. 2 is a block diagram showing the control system of the winding apparatus according to this invention.

The winding apparatus 1 comprises a controller 19 which comprises, for example, a microcomputer.

Information required to perform winding is input to the controller 19, and the controller 19 controls the rotation of the spindle motor 6, first traverse motor 12 and second traverse motor 16 based on this information.

To start winding, the controller 19 first rotates the spindle motor 6, controls the rotation of the second traverse motor 16 based on a preset diameter of the wire 7, and displaces the nozzle 8 in the axial direction of the bobbin 4 by a distance corresponding to the diameter of the wire 7 for each rotation of the bobbin 4. After the nozzle 8 has displaced a predetermined distance between the flanges of the bobbin 4, the rotation direction of the traverse motor 16 is reversed, and the nozzle 8 is displaced in the reverse direction. The number of these back and forth movements is determined according to the number of layers to be wound on the bobbin 4.

When winding is finished, the controller 19 stops the spindle motor 6, and stops the rotation of the second traverse motor 16. Next, the rotation of the first traverse motor 12 is controlled so that the nozzle 8 is displaced to a position where it does not interfere with removal of the old bobbin 4 and fitting of a new bobbin. After the new bobbin 4 has been attached, the nozzle 8 is controlled to return to its initial position.

Next, a method of winding plural coils according to this invention will be described.

Figure 4:
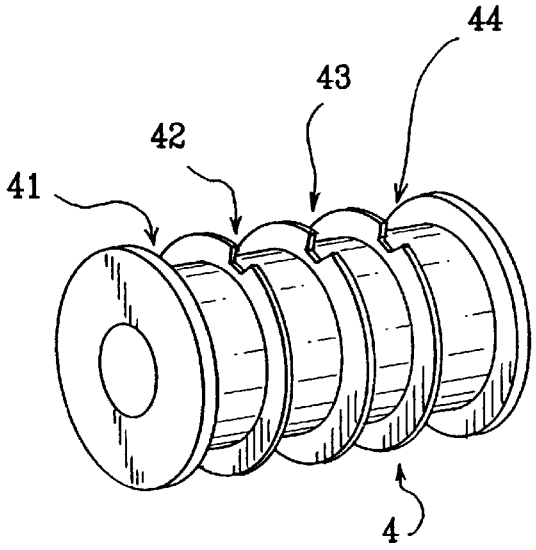
FIG. 4 is a perspective view of a bobbin divided into sections.

As shown in FIG. 4, the total length of the bobbin 4 can be divided into plural section 41, 42, 43, and section winding (split winding) performed wherein the wire is wound from a bottom layer to a top layer in each section.

In this section winding, when an ignition coil or transformer coil is wound, the nozzle 8 is moved back and forth in one section in the winding axis direction of the bobbin 4, rapidly and at a fine pitch, by the second traverse mechanism 15. The second traverse mechanism 15 is compact and lightweight, so there is no vibration when it moves or reverses at high speed, and winding misalignments do not occur. This is because the second traverse mechanism 15 is small and lightweight, so its inertia is small, and it can perform forward movements and reverse movements with a fast response.

After one section has been wound, the nozzle 8 is moved on to the next section together with the second traverse mechanism 15 by the first traverse mechanism 11.

After displacement, the second traverse mechanism 15 repeats the above operation to wind the next section.

Hence, winding can be performed accurately at a fine pitch by the second traverse mechanism 15, and as displacements between sections can be made by the first traverse mechanism 11, the entire coil can be wound in plural sections even if the second traverse mechanism 15 can only displace through a narrow range. The first traverse mechanism 11 only displaces intermittently in one direction at low speed and it does not change its displacement direction, so vibration which would cause winding misalignments does not occur.

When bank winding a coil, as there is no flange to separate sections from one another, each section of the coil must be precisely wound so that the wire turns are in an orderly arrangement.

The second traverse mechanism 15 which operates during winding moves back and forth accurately with a fine pitch and vibration does not occur even if its direction is rapidly reversed, so the coil winding alignment does not break down. This invention is therefore extremely useful also in the case of bank winding.

It is also possible to perform winding while moving the first traverse mechanism 11 at a very low speed continuously in one direction. In this case, the displacement speed of the second traverse mechanism 15 during the winding of each section is different for forward and return motion.

During forward motion, i.e., when the second traverse mechanism 15 moves in the same direction as that of the first traverse mechanism 11, the displacement speed of the second traverse mechanism 15 is set to be less by the displacement speed of the first traverse mechanism 11. On the other hand, during return motion, i.e., when the second traverse mechanism 15 was moving in the reverse direction to that of the first traverse mechanism 11, the displacement speed of the second traverse mechanism 15 is set to be larger by the displacement speed of the first traverse mechanism 11. By controlling the interaction of the two traverse mechanisms 11, 15 in this way, as the first traverse mechanism 11 moves continuously only in one direction at low speed, vibration does not occur when the displacement is stopped or reversed. Further, as the second traverse mechanism 15 is small and lightweight, vibration does not occur even if it is moved and reversed at high speed, so there are no coil winding errors, and the coil turns can be precisely wound in an orderly arrangement.

Herein, winding methods were described where the first traverse mechanism 11 was moved intermittently and where it was moved continuously, but these methods may also be combined. One example is where a combination of intermittent and continuous movement is used in sections. For example, intermittent movement may be used for the first few sections, and continuous movement used for the remaining sections. Intermittent and continuous movements may also be combined within one section. For example, the first traverse mechanism 11 may not be displaced at all up to the third layer of five layers, and it can then be displaced for the remaining two layers.

Figure 3:
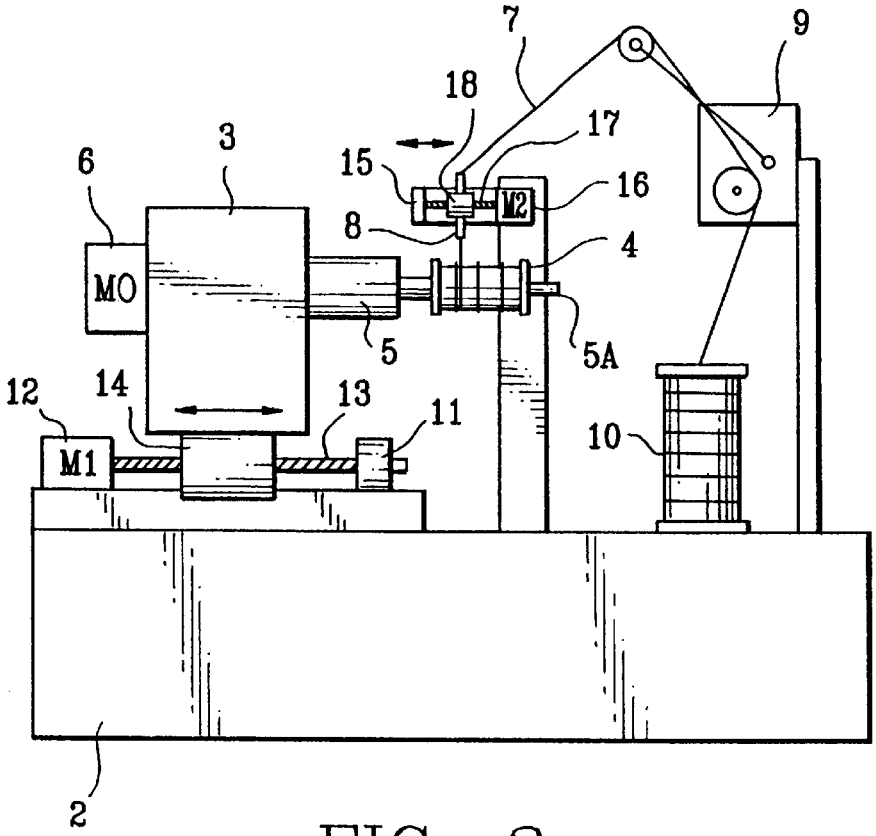
FIG. 3 is a schematic diagram of another coil winding apparatus according to the present invention.

Next, a second embodiment of this invention will be described referring to FIG. 3. In the following description, the discussion will focus on the differences from the first embodiment.

In this second embodiment, as in the case of the first embodiment, a first traverse mechanism 11 and second traverse mechanism 15 are provided which are mutually independent and have different displacement ranges and displacement pitches.

The first traverse mechanism 11 which displaces with a large pitch over a wide range is attached to the platform 2. The frame 3 is provided to the first base 14 of the first traverse mechanism 11, and the spindle 5 and spindle motor 6 are provided to this frame 3. Due to the rotation of the first traverse motor 12, the first base 14 into which the first traverse shaft 13 screws, displaces, and the bobbin 4 fitted to the jig 5A of the spindle 5 therefore moves together with the frame 3.

The second traverse mechanism 15 which displaces with a small pitch over a narrow range is also fixed to the platform 2, and the second base 18 of the second traverse mechanism 15 is provided with the nozzle 8. Hence, the second base 18 into which the second traverse shaft 17 screws, displaces together with the nozzle 8 due to the rotation of the second traverse motor 16.

The first traverse mechanism 11 displaces the bobbin 4, spindle 5 and spindle motor 6 together with the frame 3, so a large, powerful motor is used for the first traverse motor 12, the diameter of the first traverse shaft 13 is large, and it has a screw thread of large pitch.

On the other hand, the second traverse mechanism 15 only displaces the nozzle 8, so it is compact and lightweight, a small motor is used for the second traverse motor 16, the diameter of the second traverse shaft 17 is small, and it has a screw thread of fine pitch.

According also to this embodiment, the relative positions of the bobbin 4 and nozzle 8 are displaced with a large pitch over a wide range due to the first traverse mechanism 1 1, and are displaced with a fine pitch over a narrow range by the second traverse mechanism 15.

In the aforesaid construction, the bobbin 4, spindle 5 and spindle motor 6 were displaced by the first traverse mechanism 11, however the shaft of the spindle 5 and spindle motor 6 may be spline-jointed so that they can slide in an axial direction, and the spindle motor 6 may be fixed to the platform so that only the bobbin 4 and spindle 5 are displaced.

Next, a winding operation using the apparatus of this embodiment will be described.

The wire 7 is supplied from the spool 10 to the nozzle 8 via the tension device 9. As the bobbin 4 is rotating due to the rotation of the spindle motor 6, the wire 7 fed out from the nozzle 8 is wound on the bobbin 4.

At this time, the second traverse mechanism 15 displaces by a distance equivalent to the diameter of the wire 7 for each rotation of the bobbin 4. The second traverse mechanism 15 starts moving from the wind start position of the coil on the bobbin 4, and reverses its direction of motion at the wind end position. During the winding of the wire, the nozzle 8 is therefore moved back and forth between the flanges of the bobbin 4 by the second traverse mechanism 15. During this interval, the operation of the first traverse mechanism 11 is stopped.

After one coil has been wound, the second traverse mechanism 15 is stopped, the bobbin 4 which has finished winding is removed, and a new bobbin 4 is attached to begin the next winding operation. At this time, without moving the nozzle 8, the spindle 5 is moved to a position where it does not interfere with removal or attachment of the bobbin 4, i.e., at a position distant from the nozzle 8, by the first traverse mechanism 11 which has a large displacement range.

According also to this embodiment, section winding can be performed rapidly and precisely as in the aforesaid first embodiment.

In the traverse mechanism according to this invention, the first traverse mechanism 11 and second traverse mechanism 15 can be moved simultaneously. In this case, the feed speeds are controlled by the controller 19 to achieve the desired feed pitch. Specifically, the second traverse mechanism 15 is moved back and forth while moving the first traverse mechanism 11 at a fixed, low speed.

When the two traverse mechanisms are displaced in opposite directions, the nozzle 8 and bobbin 4 displace relative to one another at a speed which is the difference of those of the traverse mechanisms, so finer traverse operations can be realized.

According to the above construction, the bobbin 4 was rotated by the spindle motor 6, but this invention may be applied also to a winding apparatus using the flyer method where the nozzle 8 is made to rotate around the bobbin 4.

Also, a traverse mechanism was described which performs traverse operations by rotation of the traverse motors 12, 16, but traverse operations may be performed using linear motors.

This invention is not limited to the above embodiments which are described by way of example, various modifications being possible within the spirit and scope of the invention as defined in the attached claims.

What is claimed is:

1. A coil winding apparatus, comprising:

a spindle on which a bobbin is fitted, a wire supply part for feeding out a wire and winding it around the bobbin, a mechanism which causes the spindle to rotate relative to said wire supply part and relative to a spindle axis, and a traverse mechanism which causes the spindle and wire supply part to perform relative displacement in an axial direction of the spindle, wherein:

the traverse mechanism comprises a first traverse mechanism and a second traverse mechanism which operate independently of one another, and wherein the second traverse mechanism displaces the wire supply part in the axial direction, and the first traverse mechanism displaces the second traverse mechanism in the axial direction.

2. A coil winding apparatus as defined in claim 1, wherein:

the first traverse mechanism comprises a first traverse shaft having a screw thread and being arranged parallel to the spindle, the first traverse shaft rotating together with a first traverse motor, and a first base which displaces in the axial direction when the first traverse shaft screws into it due to the rotation of the first traverse shaft, the second traverse mechanism comprises a second traverse shaft having a screw thread and being arranged parallel to the spindle, said second traverse shaft rotating together with a second traverse motor, and a second base which displaces in the axial direction when the second traverse shaft screws into it due to the rotation of the second traverse shaft, and wherein:

the second traverse mechanism displaces together with the first base of the first traverse mechanism, and the wire supply part displaces together with the second base of the second traverse mechanism.

3. A coil winding apparatus as defined in claim 1, wherein:

the first traverse mechanism and second traverse mechanism are set to have different displacement ranges and displacement pitches.

4. A coil winding apparatus as defined in claim 3, wherein:

the second traverse mechanism has a smaller displacement range and displacement pitch than the first traverse mechanism, and is compact and lightweight.

5. A coil winding apparatus, comprising:

a spindle on which a bobbin is fitted, a wire supply part for feeding out a wire and winding it around the bobbin, a mechanism which causes the spindle to rotate relative to said wire supply part and relative to a spindle axis, and a traverse mechanism which causes the spindle and wire supply part to perform relative displacement in an axial direction of the spindle, wherein:

the traverse mechanism comprises a first traverse mechanism and a second traverse mechanism which operate independently of one another, and wherein:

the first traverse mechanism displaces the spindle in the axial direction, and the second traverse mechanism displaces the wire supply part in the axial direction.

6. A coil winding apparatus as defined in claim 5, wherein:

the first traverse mechanism comprises a first traverse shaft having a screw thread and being arranged parallel to the spindle, said first traverse shaft rotating together with a first traverse motor, and a first base which displaces in the axial direction when the first traverse shaft screws into it due to the rotation of the first traverse shaft, the second traverse mechanism comprises a second traverse shaft having a screw thread and being arranged parallel to the spindle, said second traverse shaft rotating together with a second traverse motor, and a second base which displaces in the axial direction when the second traverse shaft screws into it due to the rotation of the second traverse shaft, and wherein:

the wire supply part displaces together with the second base of the second traverse mechanism, and the spindle displaces together with the first base of the first traverse mechanism.

7. A coil winding method, comprising:

providing a spindle on which a bobbin is fitted, and a wire supply part for feeding out wire and winding it around the bobbin, rotating the spindle relative to the wire supply part and relative to a spindle axis, and winding a coil while displacing the wire supply part relative to the spindle and in an axial direction of the spindle due to first and second traverse mechanisms.

8. A coil winding method as defined in claim 7, further comprising:

displacing the wire supply part in the axial direction of the spindle by one of the traverse mechanisms to wind the coil, and displacing the wire supply part relative to the spindle by the other traverse mechanism after winding.

9. A coil winding method as defined in claim 7, wherein:

the coil is wound on a bobbin divided into plural sections, the wire supply part is displaced back and forth in the axial direction of the spindle by one of the traverse mechanisms during winding of each section, and the wire supply part is displaced to an adjacent section by the other traverse mechanism after winding of one section is complete.

10. A coil winding method as defined in claim 7, wherein:

when the coil is wound on a bobbin divided into plural sections, the wire supply part is displaced back and forth in the axial direction of the spindle by one of the traverse mechanisms during winding of each section, and the other traverse mechanism displaces the spindle relative to the wire supply part continuously in one direction in one section.

* * * * *